US005397090A

United States Patent [19]

Carson et al.

[11] Patent Number: 5,397,090

[45] Date of Patent: Mar. 14, 1995

[54] ADJUSTABLE SUSPENDED CEILING HANGERS

[76] Inventors: Bradley C. Carson, 1412 Country Rd., Troy, Mich. 48098; Russell L. Heckenberg, 1951 Parkdale, Madison Heights, Mich. 48071

[21] Appl. No.: 169,038

[22] Filed: Dec. 20, 1993

[51] Int. Cl.[6] ..... A47H 1/10

[52] U.S. Cl. ..... 248/327; 52/506.07

[58] Field of Search ..... 248/317, 323, 327, 328; 52/506.06, 506.07

[56] References Cited

U.S. PATENT DOCUMENTS

| | | | |
|---|---|---|---|
| 1,606,289 | 11/1926 | Bowers | 248/327 |
| 2,629,529 | 2/1953 | Threeton | 248/317 UX |
| 2,735,157 | 2/1956 | Hotchkiss et al. | 27/12 |
| 2,936,988 | 6/1957 | Bodian | 248/288 |
| 3,043,548 | 7/1962 | Jorgensen | 248/327 |
| 3,214,127 | 10/1965 | Skidmore | 248/327 |
| 3,263,388 | 11/1966 | Bogert | 52/665 |
| 3,495,796 | 2/1970 | Frum | 248/327 |
| 3,848,386 | 11/1974 | Catallozzi | 248/317 X |
| 3,874,035 | 4/1975 | Schuplin | 24/84 II |
| 3,995,823 | 12/1976 | Hensel | 52/506.06 X |
| 4,061,092 | 12/1977 | Jacobsen | 248/317 X |
| 4,123,027 | 10/1978 | Huntington | 248/327 |
| 4,426,822 | 1/1984 | Gailey | 52/506.06 X |
| 4,463,855 | 8/1984 | Smithers | 248/323 X |

FOREIGN PATENT DOCUMENTS

| | | | |
|---|---|---|---|
| 254474 | 5/1963 | Australia | 52/506.07 |
| 0037061 | 10/1981 | European Pat. Off. | 52/506.07 |
| 1216512 | 5/1966 | Germany | 248/327 |
| 343612 | 2/1960 | Switzerland | 52/506.07 |

*Primary Examiner*—J. Franklin Foss

[57] ABSTRACT

Adjustable hangers used in hanging loads from joists that extend across a room downward in the ceiling toward the room's floor are disclosed. The hangers have a mount for attaching to a joist, the mount having a support that joins a guide and is adapted to fit against a side of the joist and the guide to fit against a side of the joist that runs along the first side at a right angle. The support carries first and second cups at different vertical levels from one another on the support. The hangers also comprise a strand having enlargements spaced equally along its length. The strand also carries a hook for carrying the load, e.g. ceiling tile frame. Placing a select-enlargement of the strand in a cup allows for adjustment in the height of the hook. Placing the same enlargement in a different cup permits refinement in the height of the hook. Positions of the first and second cups include adjacent the support and remote from the support respectively, as well as adjacent and remote from one another. Kits comprise elements of the hanger, e.g. mount including cups, strand including enlargements and clasp.

20 Claims, 4 Drawing Sheets

FIG-1
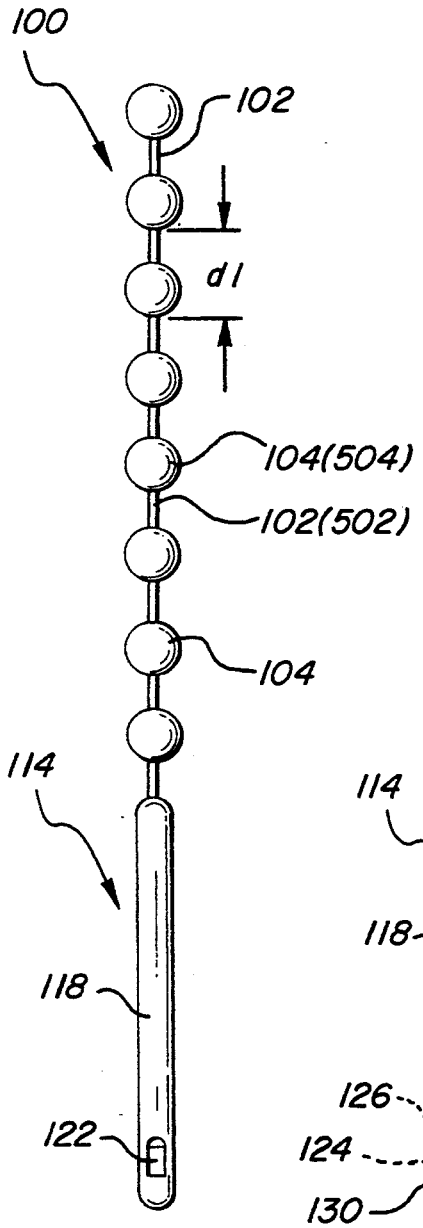
FIG-2
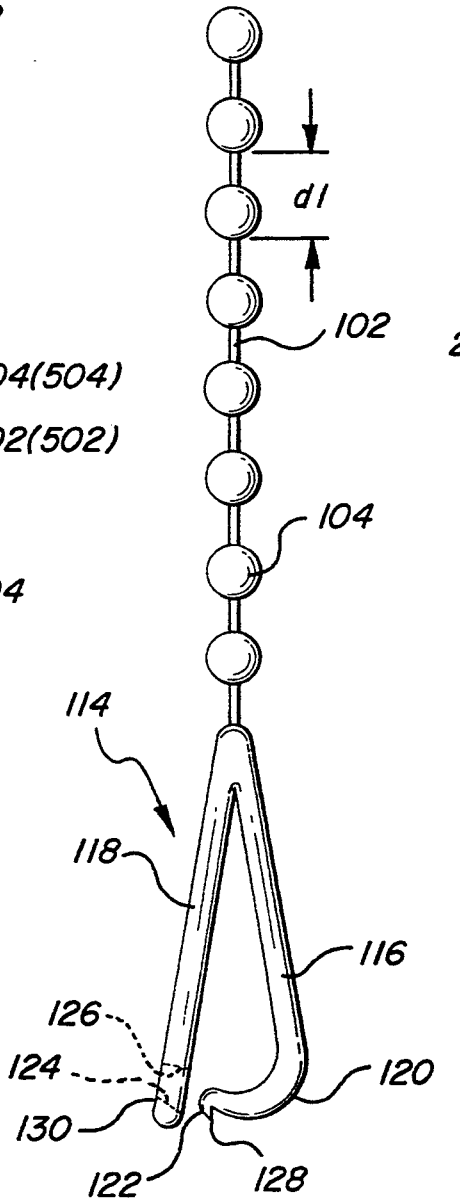
FIG-4
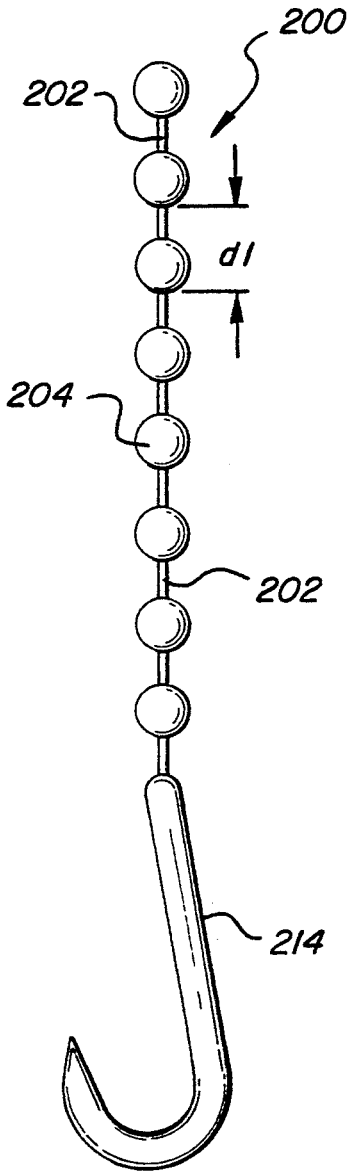
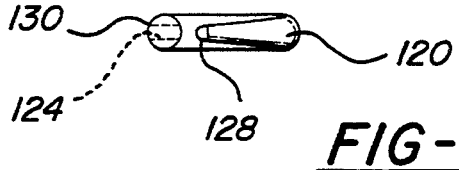
FIG-3

ADJUSTABLE SUSPENDED CEILING HANGERS

BACKGROUND OF INVENTION

This invention relates to adjustable hangers used in suspending a ceiling wherein joists, from which the hangers depend, extend across the top of a room and tiles in the ceiling are carried in frames held by the hanger. This invention, more particularly, relates to such hangers in which the stationary part of the hanger comprises catches mounted to the joist at different levels and the movable part of the hanger, attaching to a frame carrying tiles, comprises balls or other enlargements spaced along a strand and fitting in the catches. This invention, even more particularly, relates to such hangers wherein the distance the catches are spaced vertically from one another is different than the balls or other enlargements are spaced along the strand thereby permitting adjustment in the distance the frame hangs from the joist by moving either (a) a different ball or other enlargement of the strand to the same catch or (b) the same ball or enlargement to a different catch.

One known technique for adjusting distance tiles carried in frames of suspended ceilings hang from joists uses wire attached to the joist for drawing up or letting down the frames. This prior technique, although quite simple, becomes awkward and imprecise when making small adjustments. Other approaches for adjusting the distance a hanger suspends a load appear in the following U.S. Pat. Nos. 1,606,289; 2,735,157; 2,936,988; 3,263,388; 3,495,796; 3,874,035; 3,995,823. None of these patents, however, describe an adjustable hanger like the hangers of this invention.

The hanger of U.S. Pat. No. 1,606,289, for example, describes a hanger in which the strand is stationary and embedded in concrete. The hanger of U.S. Pat. No. 2,735,157 has a movable strand for making adjustments but a single catch. U.S. Pat. No. 2,936,888 describes an adjustable fixture hanger in which a clamping screw is used for making adjustments. U.S. Pat. No. 3,263,388 shows ceiling tile installation in which the tile are supported in the ceiling and adjustment is limited to moving intermeshing stems. U.S. Pat. No. 3,495,796 discloses an adjustable hanger for suspended ceilings in which adjustment is with coaxial U-shaped members having a plurality of holes in their flanges. The lower member carrying a frame for the tiles may be slid relative the upper member which is fixed in the ceiling and the members pinned together through the holes in adjusting the height of the frame. U.S. Pat. No. 3,874,035 discloses a hanger clip attachment to an overhead flanged beam providing means for connecting hangers for suspended ceilings. U.S. Pat. No. 3,995,823 discloses an adjustable hanging device in which a C- or V-shaped clamps with flexible ears have holes through which a rod extends The height of the rod is adjusted when the ears are flexed so the rod can be moved up or down.

BRIEF SUMMARY OF THE INVENTION

The adjustable hanger of this invention is for hanging a load from joists that extend across the top of a room in its ceiling. The hanger comprises a mount for attaching the hanger to a joist, the mount having a support joined to a guide and adapted to fit closely along, and attach to, a first side of the joist. The guide is adapted to fit closely along another side of the joist that runs along the first side at about a right angle. The hanger includes first and second catches fixed to the support. The catches respectively have a hole passing through them and a slot in their sides communicating with the hole. The first catch is at a first distance from a location beneath the first catch that is in front of where the support and guide join behind the first catch. The second catch is at a second, different in magnitude than the first, distance from a location beneath the second catch that is in front of where the support and guide join behind the second catch. The hanger further comprises a strand along its length having a plurality of balls or other enlargements respectively fitting in the catches. The strand, save the balls or other enlargements, passes both through the holes and the slots. The balls or other enlargements are respectively equally spaced a third distance from one another along the strand, the third distance being greater than the difference between the first and second distances. The hanger still further comprises a hook for carrying the load and connected to a part of the strand that is below the catch carrying a ball or other enlargement.

Moving adjacent balls or other enlargements to a catch permits adjustment of the hanger. And finer adjustments are accomplished by moving a ball or other enlargement from one catch to another as the catches are spaced vertically less than the distance between balls or other enlargements.

This invention also includes kits comprising elements of the aforedescribed adjustable hanger.

BRIEF DESCRIPTION OF THE DRAWINGS

FIGS. 1–3 are views depicting strand 100 used in adjusting the hanger of this invention. FIGS. 2 is a view of strand 100 of FIG. 1 rotated around to the right ninety degrees; and FIG. 3 views strand 100 rotated endwise ninety degrees into the page. FIG. 4 shows strand 200 which differs from strand 100 in the nature of the grasping means which is hook 214. Strand 100 or 200 is for use with hanger elements of either FIGS. 5–7 or 8–10 in providing the adjustable hangers of this invention.

FIG. 5 is a top plan view. FIG. 6 is a front view and FIG. 7 shows the hanger element assembly 500 of FIG. 6 rotated ninety degrees.

FIG. 8 is a top plan view. FIG. 9 is a front view and FIG. 10 shows the hanger of FIG. 8 rotated ninety degrees.

DETAILED DESCRIPTION OF PREFERRED EMBODIMENTS

Figure 5:
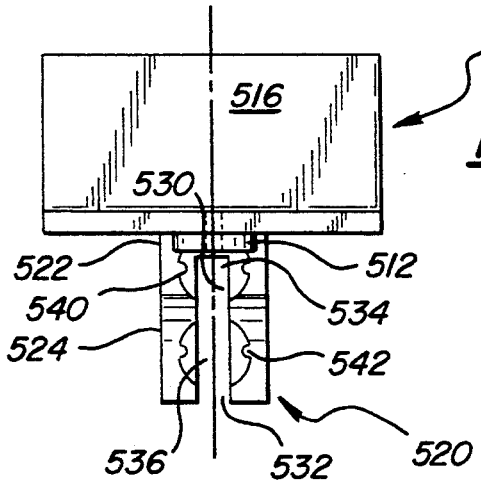
FIGS. 5–7 show hanger elements of a first embodiment of this invention in which first and second cups 522, 524 are adjacent one another.

Strand 100, as shown in FIGS. 1–2, comprises integral links 102, balls 104 and clasp 114. Links 102, equal with each other in length, and balls 104, equal in diameter with each other, alternate along strand 100. Links 102, balls 104 and clasp 114 are made of, for example, plastic and molded in a single operation preferably from engineering or other suitable plastic such as ABS, polysulphone or the like. Strand 100 in other embodiments is made of metal.

Strand 200 of FIG. 4 comprises links 202, balls 204 and hook 214. Strand 100 or 200 is designed for use with either hanger elements assembly 500 of FIGS. 5–7 or hanger elements assembly 800 of FIGS. 8–10 in providing the adjustable hanger of this invention.

FIGS. 1–3 show clasp 114 and integral strand 100 at an end thereof. Clasp 114, comprising hook and socket arms 116,118, is open in FIGS. 1–3. Hook arm 116 has integral curved end 120, which when clasp 114 is open as in FIGS. 1–3, is separate from adjoining socket arm 118 having socket 122.

Closure of clasp 114 starts by bringing hook and socket arms 116,118 together. Socket 122 has lower interior ramp 124 and upper interior ramp 126 that converge toward exit portal 130. Barbed tip 128 enters socket 122 as curved end 120 and socket 122 move together. Barbed tip 128 passes through socket 122 along ramps 124,126 to exit portal 130 as arms 116,118 close.

The shape of ramps 124,126 causes curved end 120, including barbed tip 128, to bend as arms 116,118 are pressed together. Barb tip 128 hooks onto exit portal 130 when pressure is released. Clasp 114, when closed, can carry a runner, bracket or the like of a ceiling tile frame, duct work or other fixture in the ceiling. Use of strand 100 of FIGS. 1–3 together with either hanger elements assembly 500 of FIGS. 5–7 or 800 of FIGS. 8–10, for example, provides an adjustable hanger useful in hanging ceiling tiles frames. Similarly, strand 200 is useful with either of assembly 500 or 800.

Figure 6:
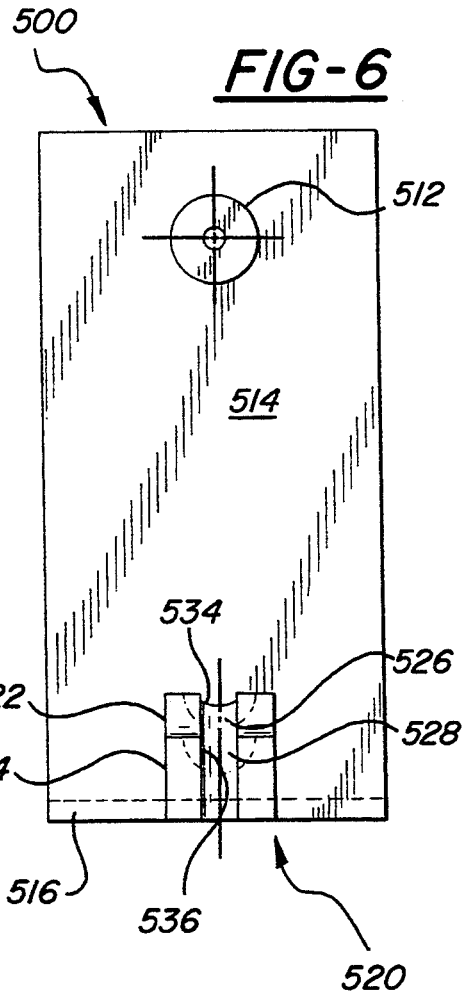
Figure 7:
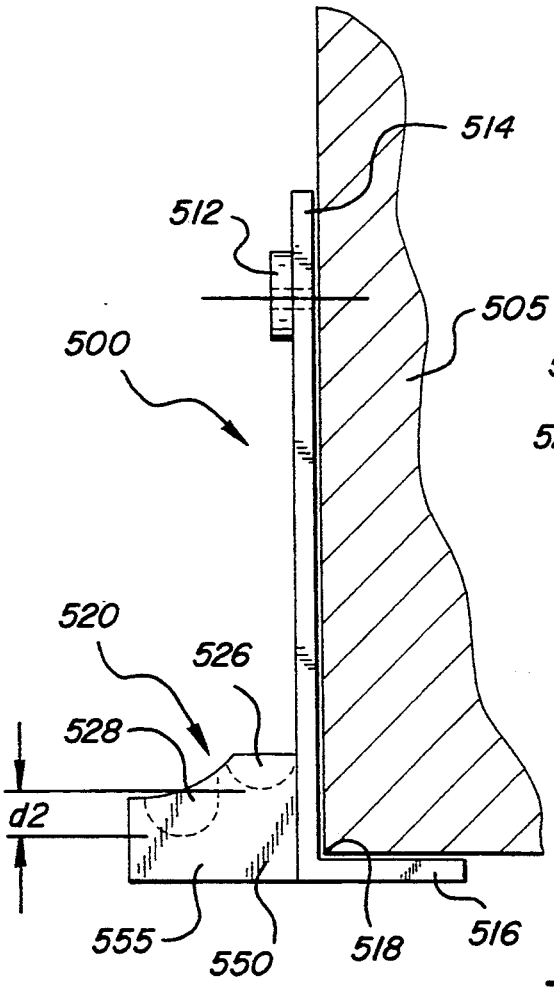

Hanger elements assembly 500 of FIGS. 5–7, shown in FIGS. 5–7, attaches to joist 505 by means of a nail or other fastener (not shown) through fastener guide 512. Fastener guide 512 facilitates precise placement of the nail or other fastener. Assembly 500 comprises support 514 integrally joined with guide 516. Support and guide 514,516, made of wood, metal or molded plastic, join at a right angle allowing their combination 514,516 to fit snugly up against lower edge 518 of joist 505.

Assembly 500 also comprises molded cup assembly 520 which may be molded together with support 514 and guide 516 from plastic such as ABS, polysulphone or like sturdy plastic. Molded cup assembly 520 has cups 522,524 adjacent one another. Cup 522 rigidly mounts on support 514. Cup 524 is integral with cup 522 and remote from support 514. Cup 522 has cup bottom 526 which has a vertical distance from location 550 (which is beneath cup bottom 526 in front of where guide 516 joins support 514 behind cup 522) that is greater than the vertical distance of cup bottom 528 from location 555 (which is beneath cup bottom 528 in front of where guide 516 joins support 514 behind cup 524). The difference of these vertical distances is identified in FIG. 7 by the letter "d2".

Cups 522,524 have slots 530,532 as shown in FIG. 5. FIG. 6 shows passages 534,536 that respectively extend through cups 522,524. Slots 530,532 communicate with one another and passages 534,536. Slots 530,532 allow links such as one of links 102 of strand 100 (see FIG. 1) to pass between cups 522, 524 in a horizontal direction.

Balls such as balls 104 in strand 100 of FIG. 1 individually fit securely in cup bottoms 526,528 of cups 522,524, respectively. Tabs 540,542, made of thin flexible material, extend over the top cups 522,524, respectively, and prevent a ball, once in one of these cups, from being knocked out should hanger elements assembly 500 be jarred. Tabs 540,542 are easily deformed to allow the balls to be inserted and removed when desired, but strong enough to prevent release of the balls upon inadvertent jarring of, for example, strand 100.

Adjustment of the hanger comprising hanger elements assembly 500 depicted in FIG. 5–7 using, for example, strand 100 depicted FIGS. 1–3, may be accomplished as follows. A select ball of strand 100 (such as ball (504) shown in FIG. 1) is placed in cup bottom 528. This is done by moving strand 100, actually a link 502 beneath ball 504, through slot 532 and allowing ball 504 to rest in cup bottom 528. For finer adjustment in the height of clasp 114 (FIGS. 1–3), ball 504 is moved to cup 522 and placed in cup bottom 526. This is accomplished by first dragging a link 502 below ball 504 through slot 530 and allowing ball 504 to drop in cup bottom 526.

Figure 8:
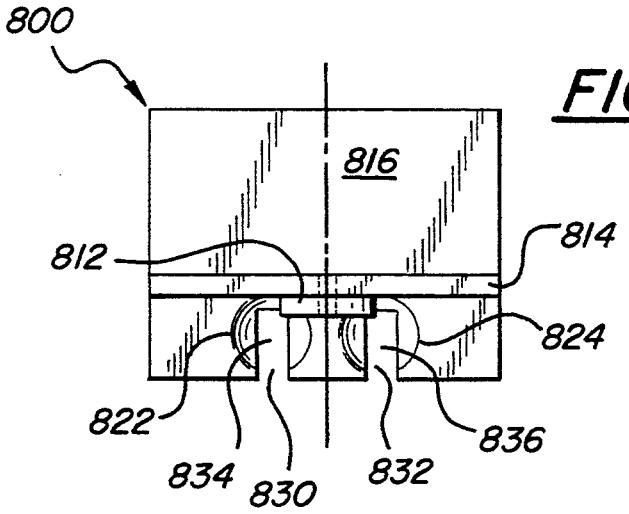
FIGS. 8–10 show hanger elements of a second embodiment, hanger element assembly 800, of this invention in which cups 822,824 are adjacent support 814 but remote from one another.
Figure 9:
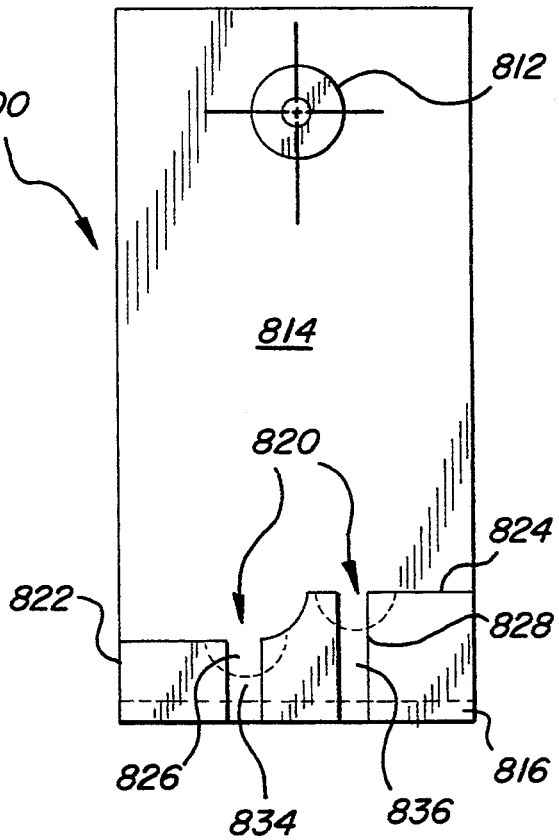
Figure 10:
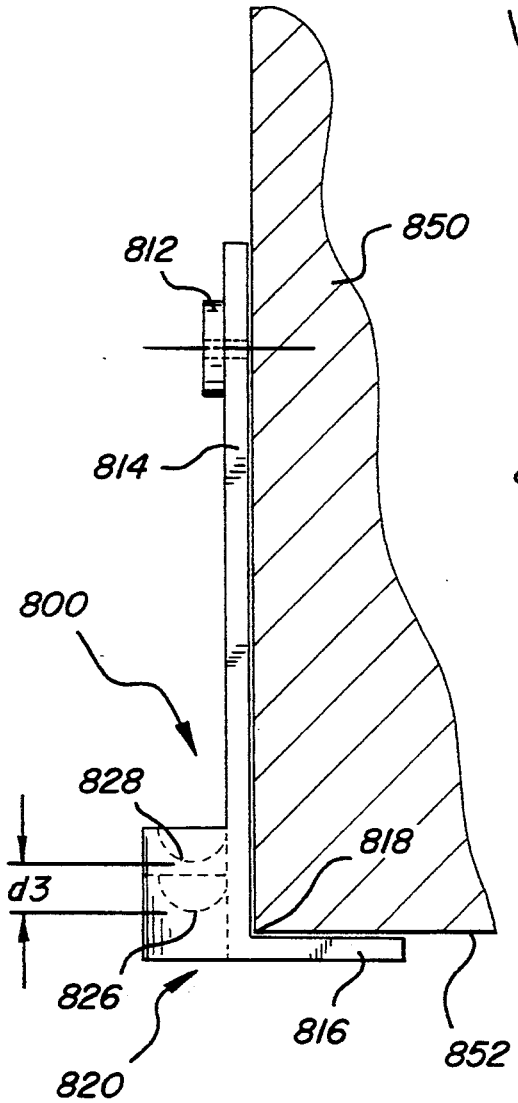

FIGS. 8–10 show another embodiment of this invention. Hanger elements assembly 800 in these FIGS. has guide 812 for mounting support 814 to joist 850 by means of a spike or other fastener(not shown). Support 814 joins to guide 816 at a right angle. Guide 816 fits on bottom 852 of joist 850 and, together with support 814, snugly around edge 818 extending along joist 850.

Assembly 800 has cup assembly 820 mounted on support 814. Cup assembly 820, mounted on support 814, has cups 822,824 which are remote one another. As is seen in FIG. 10, cup bottom 826 of cup 822 is located above that part of edge 818 behind cup 822 a lesser vertical distance than the vertical distance of cup bottom 828 of cup 824 is above that part of edge 818 behind cup 824. The difference in the heights of cup bottoms 826, 828 is identified as "d3" in FIG. 10. (In other embodiments (not shown), the assembly serving the purpose of assembly 800 is "T" shaped rather than "L" shaped as in FIGS. 8–10. In such embodiments, one or both of cups 822, 824 may be below edge 818.)

Cups 822,824 have respective slots 830,832 extending horizontally therein and opening in the same direction, as is shown in FIG. 8. As is also shown in FIG. 9, passages 834,836 extend vertically through cups 822,824, respectively. One way of adjusting the adjustable hanger (not shown) incorporating assembly 800 is by selecting different balls of the strand 100 (FIG. 1) for placement in one of the cups of assembly 800. Another way of adjusting this hanger is by lifting upward the ball (such as ball 504 of strand 100 (see FIG. 1)) carried in cup bottom 828 and bringing an adjacent lower link out through slot 832. Then, the ball 504 is placed in cup bottom 826 by passing strand assembly 100, e.g., the link below ball 504, through slot 830.

Figure 11:
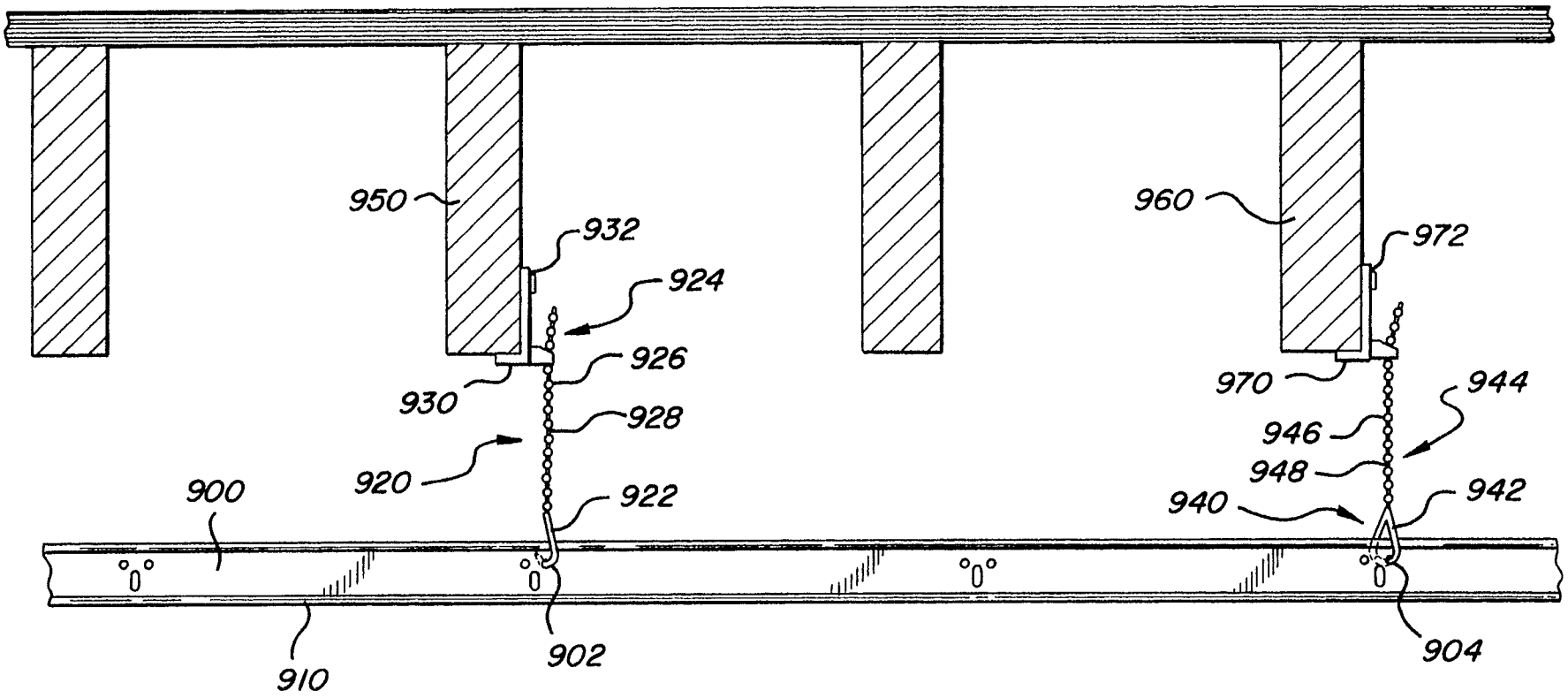
FIG. 11 depicts runner 900 of a ceiling tile frame hung from joists 950,960 by adjustable hangers 920 and 940 of this invention. Clasp 922 of hanger 920 and clasp 942 of hanger 940 extend through holes 902,904, respectively, in runner 900. Runner 900 carries ends of ceiling tile (not shown) on its lower flange 910.

FIG. 11 shows runner 900 of a frame (not shown) holding ceiling tiles (also, not shown). The tiles are carried on lower flange 910 of runner 900. Clasps 922,942 of respective adjustable hangers 920, 940 extend through holes 902,904, respectively, of runner 900. Hangers 920,940 are mounted to joists 950,960. Hanger 920 comprises strand 924 with balls 926 and links 928. Hanger 920 also has guide 930 and support 932 firmly mounted on joist 950. Similarly, hanger 940, mounted to joist 960 with guide 970 and support 972, has strand 944 with balls 946 and links 948.

Preferred adjustable hangers of this invention have strand assemblies in which distance "d1" equals 0.25 inches (0.625 millimeters) and distance "d2" and "d3" are 0.125 inches (0.3125 millimeters), respectfully. The diameter of the balls used in these preferred embodiments is 0.125 inches. These dimensions optimally allow fine adjustment of the hanger by moving adjacent balls to a catch and even finer adjustment by moving a ball to an adjacent catch. Such distances between the balls permit them to be held firmly in the catches without interference from adjacent links.

Spherical configuration of the enlargements are preferred but other configurations, such as cubes, half spheres, disks, cylinders and the like are also useful. In such cases, modification of the catch geometry may be appropriate, particularly for shapes other than spherical.

Description of the foregoing is intended as illustrative of this invention and not to limit its scope which is limited only by the appended claims.

What is claimed is:

1. An adjustable hanger for hanging a load from a joist that extends across the top of a room and downward toward its floor, said hanger comprising:

a mount for attaching said hanger to a joist, said mount having a support joining to a guide and adapted to fit closely along, and attach to, a first side of said joist, said guide adapted to fit closely along a second side of said joist that rune along said first side at about a right angle;

first and second catches carried by said support and respectively having a hole passing therethrough and a slot in a side thereof communicating with said hole, said first catch being at a first distance from a location beneath said first catch that is in front of where said support and guide join behind said first catch and said second catch being at a second, different from said first, distance from a location beneath said second catch that is in front of where said support and guide join behind said second catch;

a strand along its length having a plurality of integral enlargements that respectively fit in said catches, said strand, save for said enlargements, passing through said holes and said slots, said enlargements respectively equally spaced a third distance from one another along said strand, said third distance being greater than the difference between said first and second distances;

a hook for carrying said load and connected to a part of said strand that is below that catch carrying an enlargement.

2. A hanger in accordance with claim 1, wherein said first and second catches are adjacent one another.

3. A hanger accordance with claim 2, wherein said first catch carries said second catch remote from said support.

4. A hanger in accordance with claim 3, wherein said slots face one another.

5. A hanger in accordance with claim 3, wherein said slots face different directions.

6. A hanger in accordance with claim 2 wherein said first catch carries said second catch adjacent said support.

7. A hanger in accordance with claim 6, wherein said slots face one another.

8. A hanger in accordance with claim 6, wherein said slots face in different directions.

9. A hanger in accordance with claim 1, wherein said enlargements have a round configuration.

10. A hanger in accordance with claim 9, wherein surfaces of said catches have a rib.

11. A hanger in accordance with claim 1, wherein said hook comprises a clip that can grasp around said load.

12. A hanger in accordance with claim 1, wherein said catches are remote from one another.

13. A hanger in accordance with claim 12, wherein said second catch is adjacent said support.

14. A hanger in accordance with claim 13, wherein said slots face each other.

15. A hanger in accordance with claim 13, wherein said slots face different directions.

16. A hanger in accordance with claim 12, wherein said second catch is remote from said support.

17. A hanger in accordance with claim 16, wherein said slots face each other.

18. A hanger in accordance with claim 16, wherein said slots face different directions.

19. A kit for an adjustable hanger, said hanger for hanging a load from joists that extend across a room downward toward its floor, said kit comprising a mount for attaching said hanger to a joist, said mount having a support joining to a guide and adapted to fit closely along, and attach to, a first side of said joist and said guide adapted to fit a surface of said joist that runs along said first side at about a right angle; first and second catches adapted to be carried by said support and respectively having a hole passing therethrough and a slot in a side thereof communicating with said hole, said first catch adapted to be carried at a first distance from a location that is beneath said first catch and across from where said guide joins to said support behind said first catch and said second catch adapted to be carried at a second, different than said first, distance from a location beneath said second catch and across from where said support joins said guide behind said second catch.

20. A kit for an adjustable hanger, said hanger adapted to hang a load from joists that extend across the top of a room downward toward its floor, said kit comprising: a mount adapted for attaching said hanger to a joist, said mount having a support joining to a guide, said support adapted to fit along, and attach to, a first side of said joist and said guide adapted to fit along surface of said joist that runs along said first side at about a right angle; first and second catches adapted to be carried by said mount and respectively having a hole passing therethrough and a slot in a side thereof communicating with said hole, said first catch carried by said support at a first distance from a location that is beneath said first catch and across from where said guide is adapted to join to said support behind said first cup and said second cup adapted to be carried at a second, different than said first, distance from a second location that is beneath said second cup and across from where said guide piece joins said support behind said second cup; a strand having a plurality of integral enlargements and capable of, save for said enlargements, passing through said holes and said slots, said enlargements respectively equally spaced a third distance from one another along said strand, said third distance being greater than the difference between said first and second distances.

* * * * *